United States Patent [19]

Pastien

[11] Patent Number: 4,518,073

[45] Date of Patent: May 21, 1985

[54] VEHICLE LOCK APPARATUS AND METHOD

[75] Inventor: Eugene R. Pastien, Moundsview, Minn.

[73] Assignee: Smarte Carte, Inc., White Bear Lake, Minn.

[21] Appl. No.: 512,149

[22] Filed: Jul. 8, 1983

[51] Int. Cl.[3] ..... G07F 7/06

[52] U.S. Cl. ..... 194/4 C; 186/27

[58] Field of Search ..... 194/4 C, 4 D, 4 F, 4 R; 186/27; 410/139; 104/145, 167; 296/65 R; 188/32, 40

[56] References Cited

U.S. PATENT DOCUMENTS

| | | | |
|---|---|---|---|
| 703,818 | 7/1902 | Plattenburg | 188/40 |
| 3,165,189 | 1/1965 | Easterday | 194/4 |
| 3,194,377 | 7/1965 | Fischbach et al. | 194/4 |
| 4,262,600 | 4/1981 | Carney et al. | 104/172 BT |
| 4,377,227 | 3/1983 | Sandford | 194/4 R |
| 4,438,702 | 3/1982 | Rhodes | 104/172 B |
| 4,457,551 | 7/1984 | Anthony | 296/65 R |

*Primary Examiner*—Stanley H. Tollberg
*Attorney, Agent, or Firm*—Merchant, Gould, Smith, Edell, Welter & Schmidt

[57] ABSTRACT

A lock mechanism (12) discriminates between "valid" and "invalid" keys that are mounted to grocery carts (114). A valid key (98) includes a key portion (106) that passes through an ingress template opening (21) and into the lock mechanism (12). The lock mechanism (12) includes a first door (42) and a second door (62) through which the key (98) must pass. Opening the first door (42) causes a door latch (50) to engage the second door (62) so that the second door (62) cannot be opened while the first door (42) is open. Once the first door (42) closes the second door is "enabled" to open, the door latch (50) returning to its original position. A depth gauge (66) is acted upon by the lowermost portion (112) of the key (98) so that the depth gauge (66) disengages from the second door (62) to allow the second door (62) to open once it is engaged by the valid key (98). Opening the second door (62) cocks a vend bar (40) which is connected to a vend mechanism within a dispenser column (14). Once the valid key (98) passes beyond the second door (62), the second door (62) returns to its original position and the vend bar (40) uncocks, thus causing the dispenser mechanism to issue a reward to the returner of the cart. A channel (16) prevents the cart key from being upwardly removed once the cart key engages the channel (16) subsequent to passing through the lock mechanism (12).

22 Claims, 8 Drawing Figures

VEHICLE LOCK APPARATUS AND METHOD

FIELD OF THE INVENTION

This invention relates generally to vehicle lock methods and apparatuses, and more particularly to lock means responsive to a key carried by a vehicle, e.g. a grocery cart, wherein if the cart key is "valid," the key and cart may irreversibly proceed through the lock and the lock preferably dispenses an incentive.

BACKGROUND OF THE INVENTION

Although embodiments of methods and apparatuses of the present invention would be useful for any vehicle, for the sake of brevity a grocery cart application will be emphasized throughout.

Grocery carts and the like are very commonly supplied by store owners for retail store patrons. The patrons typically use the carts while in the store and may also use the carts to transport the purchased goods from the stores to the parking areas and ultimately to their automobiles.

This benefit for the store patrons presents a long-standing problem for the store owners, however: the relatively expensive carts are very often damaged or not returned to the store or to another central location in the parking area. Oftentimes the problem results simply from the negligence of the patrons, but it is well-known that carts are often "borrowed" for subsequent use and occasionally carts are stolen for resale purposes. In any event, the loss of carts is problematical for the store owner. When carts are stolen, fewer carts are available for the patrons, and if the carts are replaced this results in a drain on the store owner's income. In fact, it is presently estimated that the average life of a grocery cart is approximately three years and even less in high crime areas. The magnitude of the problem becomes clear when it is realized that grocery carts can cost in excess of $100.

It is perceived that one possible solution to the aforementioned problem is to provide a central location or several locations where the carts can be returned. If a plurality of cart return stations are provided by the store owner, preferably in the parking area, it is thought that the carts would be more likely returned.

Even more effective than the simple return system outlined above is an incentive system. In this type of scheme a token is dispensed to the individual who returns the cart to provide incentive for prompt return of the carts. Such a token might be a small monetary sum or a ticket or coupon useful in the store supplying the cart return apparatus and the carts. Even more preferred would be a device that provides incentive for people to return carts to the very store from which the carts were derived. This is particularly a problem in commercial areas where there are many retail stores and many of the stores supply carts that are similar in nature to one another. The store owners naturally desire to have their carts returned to their own store.

Consequently, a preferred cart return apparatus would include means for issuing an incentive to the individual who returns a cart to the appropriate store's return apparatus. A preferred apparatus would be fairly simple in construction and be very rugged to minimize maintenance problems and resultant down time. An incentive dispenser should not operate unless a cart is genuinely returned. That is, the dispensing system should be tamper-proof to a significant degree.

A preferred apparatus and method for encouraging the return of grocery carts and the like is further readily adaptable to presently-existing carts. That is, retrofitting of carts should be fairly simple and straightforward. Any parts that are mounted to grocery carts should not interfere with the convenient use of the carts and should be fairly inexpensive.

A preferred apparatus and method should also include means for preventing removal of the cart without the store owner's consent. This prevents repeated "returns" of a single cart by a single party for an accumulated sum of tokens or incentives.

Finally, a preferred apparatus should offer little resistance to pushing the cart into the apparatus so that patrons can easily return the carts in return for tokens.

The prior art devices do not possess all of the preferred characteristics itemized above. One cart return device, manufactured by Smarte Carte, Inc. of White Bear Lake, Minn., generally performs quite satisfactorily, possessing most of the preferred characteristics stated above. In the Smarte Carte device, the rear wheels of a fairly standard grocery cart are modified to extend outwardly from the cart frame. The rear wheels are thus capturable by a cart return device. A problem exists, however, due to the outward extension of the modified wheels: the extended wheels sometimes interfere with the grocery shopping process, e.g., two carts, each supplied with the extended wheel base, interfering with one another as they attempt to simultaneously negotiate a narrow aisle, with a resultant inconvenience to store patrons.

U.S. Pat. No. 3,165,189, issued to R. Easterday, discloses another cart return apparatus. Easterday teaches a key connected to a cart frame, the key engaging a lock apparatus as the cart is moved from a starting point to an ending point. If the key is of a proper configuration, the key can pass through the lock apparatus and the passage of the key through the lock mechanism causes the lock mechanism to dispense a token.

The concept of a key mountable on a standard grocery cart is generally laudable, but Easterday and similar devices suffer from several drawbacks. The key in Easterday is a fairly simple disk mounted in cantilever fashion, extending laterally from the grocery cart frame. The key is thus prone to interfere with the shopping process due to problems which can occur due to the limited space in a typical grocery store. Such problems were discussed above with reference to the Smarte Carte device, though in the Smarte Carte device it is the extended wheels that are somewhat problematical.

The key in Easterday, a simple disk, would be fairly easily copied by someone who wishes to simulate the return of a cart in repeated fashion to amass a large sum of tokens.

Furthermore, since the key in Easterday and like devices is mounted on one side of the grocery cart frame, it is perceived that a torque is generated on the grocery cart frame as the key is pushed through the lock apparatus, causing binding of cart wheels in the channels that guide and support the cart wheels.

Additionally, the type of cart return device represented by Easterday requires that the grocery cart wheels be aligned and in good condition so that they can traverse the fairly narrow cart wheel channels that guide the cart and key through the apparatus. If a wheel is damaged so that it will not easily follow the narrow wheel channels or the wheels are misaligned, it is perceived that it may be difficult or impossible to return the cart for a token.

Still further, Easterday teaches that in order to prevent one store's carts from being returned to another store's cart return mechanism, the return mechanisms should be mounted at various heights and the keys mounted on the carts at corresponding various heights. Several problems may be caused by such a system, including problems caused when two locking mechanisms are mounted at substantially the same height. Patrons may be able to return carts to the wrong stores in such a situation, or perhaps jam the key disks in the lock mechanisms when trying to do so.

The present invention is directed to the problems discussed above. The cart return apparatus of the present invention is very rugged and includes superior means for discriminating between carts from various stores. A key preferably having a fairly complex shape is preferably centrally mounted to the cart frame between the front wheels of a typical grocery cart. The complex shape of the key can be easily varied in a given commercial area to prevent the crisscrossing of carts between and among stores. The preferably central location of the key minimizes binding of the carts in the return mechanism and lessens the risk of harming the store, its contents or patrons. Likewise, damage to the key itself is minimized due to the placement of the key between the front wheels of the cart. The cart frame acts to protect the key, thus extending the useful life of the key.

In a preferred embodiment of the invention, only the cart key engages a guide mechanism so that misaligned or broken wheels will not significantly hinder the return of a cart and the dispensing of a token as a reward.

Furthermore, a cart return mechanism according to the present invention is essentially tamper-proof. Preferably, the key must pass through two doors in order to activate the token dispensing system. In one embodiment, a template having an opening roughly conforming to the shape of the key is mounted in front of the first door. Once the key passes through the first door, it preferably comes into contact with a depth gauge which, like the template mentioned above, determines whether the key is "valid" and whether a token should be dispensed. In order for the key to open the second door, the first door must be closed. Thus, a slender tool cannot readily be pushed through the first door and through the second door since the second door is held closed by enabling means when the first door is held open.

A preferred embodiment of the invention also preferably includes rugged means for preventing the key from being reversed through the locking mechanism to preclude multiple-token rewards for the return of a single cart.

Finally, the complexity of the key of the present invention makes it difficult to copy and thus reduces spurious token loss.

SUMMARY OF THE INVENTION

Accordingly, the present invention includes a vehicle lock apparatus that is operable in response to movement of a vehicle, the vehicle including a "valid" key having first and second characteristics. The valid key is operatively connected to the vehicle and is configured to come into operative proximity with the lock apparatus during the predetermined movement of the vehicle. The valid key is configured to operatively engage the vehicle lock apparatus to change the lock apparatus from a first state to a second state, e.g. allow the vehicle to pass through the vehicle lock and, in one embodiment, dispense a token in reward for the return of the cart.

The lock apparatus discussed above includes a first means for detecting the valid key first characteristic. The first detecting means changes from a first state to a second state in response to movement of a valid key as the vehicle moves. That is, the first detecting means changes between a first state and a second state only if the valid key first characteristic is "detected." In one embodiment, the first detecting means includes a template and a first door, the door opening if the key passes through the template.

A lock apparatus further includes a second means that likewise detects a valid key second characteristic and changes between a first state and a second enabled state in response to movement of the vehicle if the valid key second characteristic is "detected." a depth gauge and a second door are included in the second detecting means in one embodiment.

An enabling means operatively interconnects the first detecting means and the second detecting means. The enabling means prevent the second detecting means from changing from its first state to its second enabled state when the first detecting means is in its second state.

The lock apparatus of the present invention further includes anti-reversing means operatively connected to the second detecting means. The anti-reversing means substantially prevents a key from passing through the lock apparatus in a reverse direction.

The lock apparatus changes from its first state to its second state in response to the second detecting means changing from its first state to its second enabled state.

In one preferred embodiment, the first detecting means includes a first door and the second detecting means includes a second door, the doors being closed in their first state and open in their second state. In this embodiment, the anti-reversing means mentioned above is operatively connected to the second door and prevents the second door from being opened to prevent a key from passing in a reverse direction through the lock apparatus.

Furthermore, a preferred embodiment of the invention includes first detecting means that determine whether the overall shape and size of a key is substantially similar to the overall shape and size of the "valid" key. A template in front of the first door serves this purpose.

Another embodiment of the lock apparatus of the present invention includes a depth gauge as the second detecting means. The depth gauge is generally disposed between the first and second doors and is operatively connected to the second door. If the lowermost portion of a key is substantially similar to the lowermost portion of the valid key, the depth gauge operates to permit the second door to be opened.

As previously noted, one preferred embodiment of the invention includes means for dispensing a token in response to the second door changing between its first state and its second state, i.e. changing between its closed state and its open state. The token dispensing means is operatively connected to the second door.

Also, a preferred embodiment of the lock apparatus is operable in response to a valid key operatively connected to a grocery cart, wherein the valid key is centrally disposed between the front wheels of the grocery cart. One embodiment of the invention is a vehicle, e.g., a grocery cart, that includes a valid cart key operatively connected substantially midway between the front wheels of the cart.

The token dispensing means, in one embodiment, includes a vend bar which is slidably disposed in a frame which supports the components of the lock apparatus, the vend bar being operatively connected to a token dispenser. When the second door changes between its first state and its second state, the vend bar is activated, consequently the token dispenser is activated and the individual returning the cart is rewarded.

Another embodiment of the present invention includes a vehicle lock system that includes a vehicle, a valid key of the type discussed above operatively connected to the vehicle, and a vehicle lock apparatus as discussed above.

Additionally, the present invention includes a method for detecting a vehicle of the type having a valid key, wherein the valid key possesses first and second characteristics. The detecting method includes detecting the valid key first characteristic and opening a first door in the event that the valid key characteristic is "detected"; preventing a second door from opening while the first door is open; closing the first door when the first key reaches an intermediate point between the first and second doors; allowing the second door to open once the key reaches the intermediate point; detecting the valid key second characteristic and opening the second door if the valid key second characteristic is detected; vending a token in response to opening and closing of the second door; slidably containing the valid key; and preventing the valid key from travelling in a reverse direction through the second door.

DETAILED DESCRIPTION OF THE INVENTION

Figure 1:
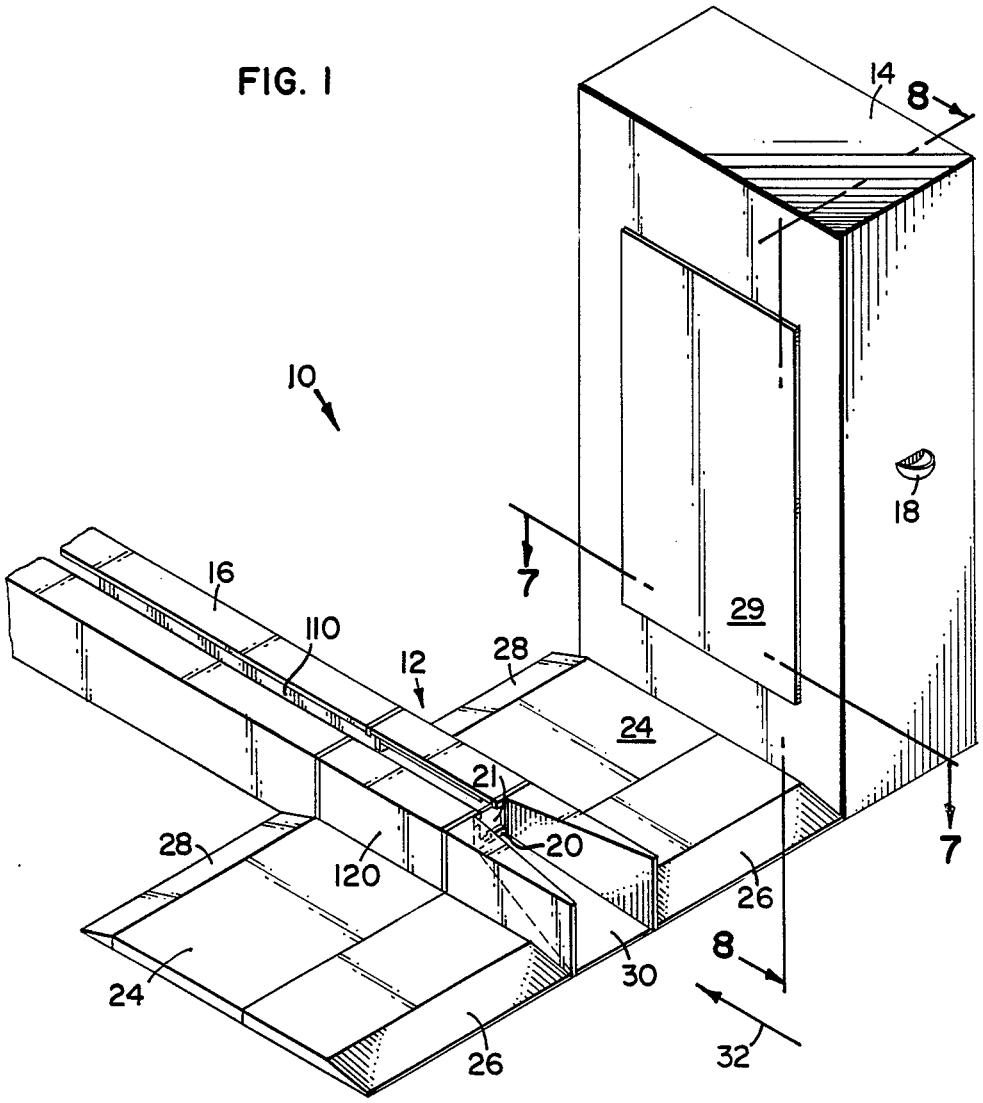
FIG. 1 is a perspective view of a grocery cart return apparatus constructed according to the principles of the invention, including a key lock apparatus.

In the following detailed description of the invention, like reference numerals represent like components and assemblies throughout. It should be noted that although the following description is directed to a grocery cart return apparatus, the invention is generally applicable to vehicle lock apparatuses and methods, a grocery cart simply being one type of vehicle.

A perspective view of a grocery cart return apparatus, one embodiment of the present invention, is shown in FIG. 1 and is indicated generally with the reference numeral 10. The cart return apparatus 10 generally includes a key lock mechanism 12, a dispenser column 14 and key channel 16. The key lock mechanism 16 is preferably made of heavy-gauge stainless steel, and has a slot in its top surface of sufficient width to slidably restrain a cart key as further discussed below. The key lock mechanism 12 is mechanically linked by a vend bar 40 (FIG. 2) including an enlarged tip 39 to a dispensing mechanism 142 (FIG. 8) within the dispenser column 14. Briefly, the key lock mechanism 12 is configured to accept a valid key 98 (FIG. 6) having a particular shape and size, the key preferably being mounted to the underside of a grocery cart 114 (FIG. 5) substantially midway between the front wheels of the cart 114. If the cart key has the proper shape and size, when the cart key passes through the key lock mechanism 12 the vend bar 40 is cocked and released, as further described below, and a token is dispensed into a token cup 18 extending from the dispenser column 14.

An ingress template 20 defining an ingress template opening 21 that corresponds to the size and shape of the cart key 98 is positioned at the front of the lock mechanism 12. If the cart key is "valid" it will pass through the template opening 21 and into the key lock mechanism 12. Ultimately, if the key is substantially similar to a valid key 98, it will pass through the key lock mechanism 12 and into the key channel 16 where it is slidably contained. A slot 110 in channel 16 allows the key to freely slide. The key channel 16 can have any length to provide for nesting of a convenient number of carts. At the opposite end of the key channel 16 there is preferably a simple hinged door or the like that can be locked to prevent the unauthorized taking of carts. Alternatively, the key channel 16 may feed directly into the interior of a store so that carts may be freely accessed by patrons of the store therein.

FIG. 1 also shows a pair of entrance ramps 26 leading up to a pair of top panels 24 which are also connected to a pair of exit ramps 28. The ramps 26 and 28 and panels 24 accommodate the wheels of a grocery cart and provide space beneath the top panel 24 for the vend bar 40 (FIG. 2) connecting the key lock mechanism 12 to the dispenser mechanism (not shown) within the dispenser column 14. The ramps 26 and 28 and panel 24 are preferably formed using stainless steel sheet metal and are interconnected using rivets or the like, as understood by those skilled in the art of sheet metal fabrication. An access panel 29 enables service personnel to access the vend mechanism for periodic service and to replenish the token supply.

A key funnel 30, preferably a steel weldment, includes three inclined surfaces leading toward the ingress template 20 and ingress template opening 21. The key funnel 30 directs the cart key into the key lock mechanism 12 without requiring the individual returning the cart to precisely register the cart key with the ingress template opening 21.

Figure 2:
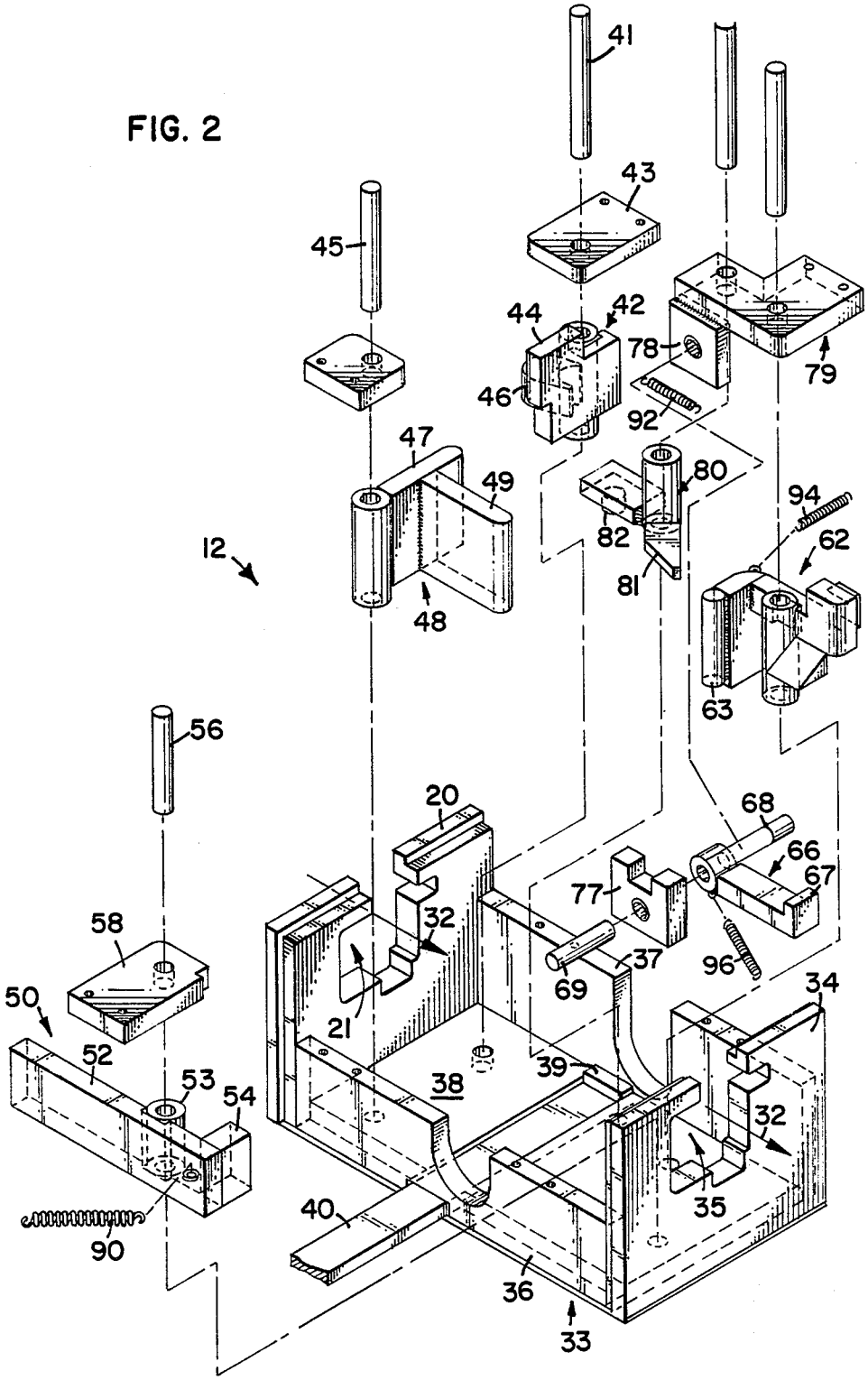
FIG. 2 is an exploded perspective view of the key lock apparatus shown in FIG. 1.

FIG. 2 shows an exploded perspective view of the key lock mechanism 12. It should be noted that the key lock mechanism 12 has been rotated in FIG. 2 relative to the orientation shown in FIG. 1. A pair of arrows 32 indicate that direction in which the cart key travels as it passes through the key lock mechanism 12.

A key lock mechanism frame, generally indicated as 33, supports the moving parts of the embodiment of the key lock mechanism 12 herein discussed. The frame 33 includes an ingress template 20 that defines an ingress template opening 21 as discussed above. An egress template 34 is located at the opposite end of the lock mechanism 12, the egress template 34 defining an egress template opening 35. The lock mechanism frame 33 further includes a first side plate 36, a second side plate 37 and a bottom plate 38. The side plates 36 and 37, templates 20 and 24, and bottom plate 38 are interconnected by any convenient means, including welding. Cold-rolled steel plate stock is the preferred material for the components of the lock mechanism frame 33, and the components are milled and generally worked using well-known techniques. The bottom plate 38 is grooved to accommodate the vend bar 40 which, as explained above, interconnects the key lock mechanism 12 and the vend mechanism within the dispenser column 14. The first side plate 36 is likewise relieved to slidably accommodate the vend bar 40.

The lock mechanism frame 33 serves to hold a plurality of components in cooperative relationship with one another that form a lock mechanism which discriminates between "valid" cart keys 98 and "invalid" cart keys. Most of the moving parts of the lock mechanism 12 are vertically pivotally held by the lock mechanism frame 33.

The first moving part of the key lock mechanism 12 that a key normally encounters is a first door 42. The first door 42 is rotably pinned to the frame 33 by a first door pin 41, and the pin 41 is frictionally restrained by the bottom plate 38 and a first door plate 43. The first door plate 43 is preferably fastened to the second side plate 37 with screws (not shown).

The first door 42 includes an upper first door portion 44 that is located and configured to make contact with a key, assuming the key passes through ingress template opening 21. The torque on first door 42 thus generated causes first door cam 46 to push against a first portion 47 of latch cam 48 as further discussed below. Latch cam 48, like first door 42 and the other moving parts of lock mechanism 12, are preferably formed of cold-rolled steel and are weldments, unless specified otherwise.

Figure 3:
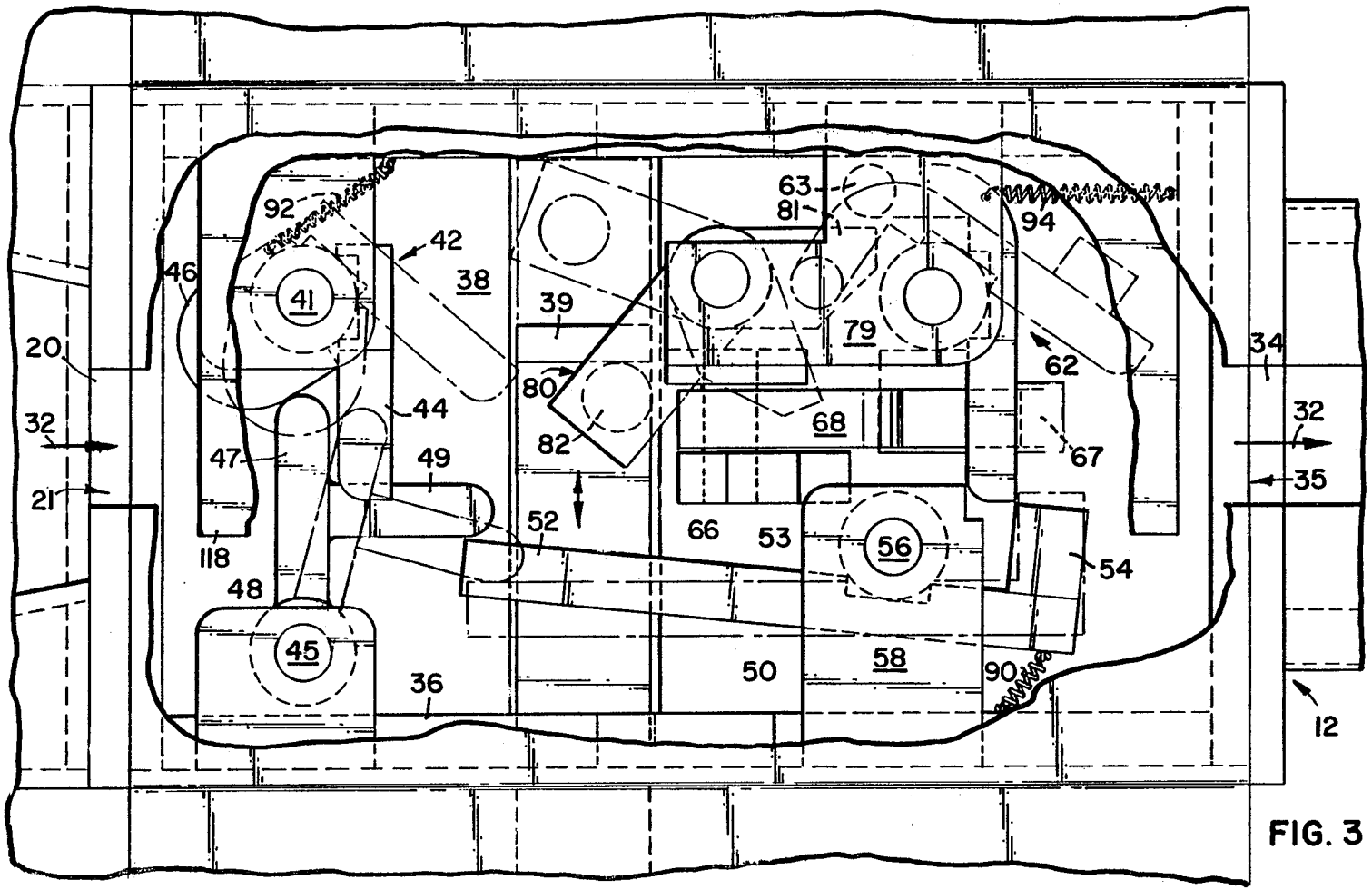
FIG. 3 is a top plan view of the key lock apparatus shown in FIG. 1, the cover being broken away.

FIG. 3, a top plan view of the key lock mechanism 12, shows the relative positioning of the first door 42 and the latch cam 48. In FIG. 3, solid lines represent the "initial" positions of the components of lock mechanism 12 while phantom lines represent the positions upon engagement of the doors by the key. FIG. 3 clearly shows that the first door cam 46 pushes against and generates a torque on latch cam 48, the first door cam 46 being in contact with latch cam first portion 47. Latch cam 48 is thus caused to rotate about pivot pin 45, latch cam 48 being rotatably pinned to the lock mechanism frame 33 in substantially the same fashion as first door 42. The latch cam second portion 49, extending substantially perpendicular from the latch cam first portion 47, is thus caused to engage and push against a door latch 50.

The door latch 50 is comprised of cold-rolled steel and is preferably a weldment including three portions, a cam engaging portion 52, a door catch 54 and a tubular portion 53. FIG. 2 shows a perspective view of door latch 50 and the means by which it is rotatably connected to the frame 33. A pin 56 is held by a door latch cap 58 and by the frame bottom plate 38. The tubular portion 53 of the door latch 50 pivots about the pin 56 and therefore the entire door latch 50 pivots about the pin 56. It should be noted that latch cam 48 and first door 42 are similarly pivotally constrained by the frame 33. It should also be noted that the tubular portions of the moving parts of lock mechanism 12 preferably include sintered bronze inserts to minimize friction between the moving parts and the pins.

As shown in FIG. 3, the door latch 50 pivots about pin 56 upon being engaged by the latch cam second portion 49. Once pivoted to the position indicated in phantom in FIG. 3, door catch 54 of door latch 50 engages the egress side of a second door 62. The second door 62 is also operatively engaged on its egress side by a depth gauge 66. Depth gauge 66 is horizontally pivotally restrained by the frame 33 of lock mechanism 12. A depth gauge catch 67 engages the egress side of the second door 62 unless the depth gauge 66 is sufficiently pivoted downward. Depth gauge 66 includes a depth gauge ramp 68 which is positioned to make contact with the lowermost portion 112 of a valid key 98 (FIG. 4) having a proper depth with reference to the key lock mechanism 12. If the depth gauge ramp 68 is engaged by a key, it is pushed downward and the depth gauge catch 67 disengages from the egress side of the second door 62. The depth gauge 66 pivots about a depth gauge pin 69 that is held by a depth gauge pin first holder 77 and a depth gauge pin second holder 78 which extends from and is preferably welded to a second door cap 79.

If the second door 62 is allowed to pivot, the depth gauge catch 67 and the door catch 54 being out of the way, the second door 62 will pivot and make contact with a vend pivot 80 shown in perspective in FIG. 2. The vend pivot 80 includes a triangular portion 81 that is arranged to make contact with a second door circular member 63. This generates a torque on the vend pivot 80 which further generates a force on a pivot stud 82. The enlarged tip 39 of vend bar 40 extends upward from the top surface of vend bar 40 and allows the vend pivot stud to transfer an axial force to the vend bar 40. The lock mechanism 12 is so designed that the force on vend pivot 82 and thus the force generated by the stud 82 will be sufficient to "cock" vend bar 40, thereby preparing the vend mechanism to dispense a token.

As shown in FIG. 2, the key lock mechanism 12 preferably includes four extension springs. A door latch extension spring 90 serves to urge the door latch 50 into the position shown in solid line in FIG. 3. Likewise, a first door spring 92 urges the first door toward the orientation shown in solid line in FIG. 3. The second door 62 is also urged to a closed position by a second door spring 94. Finally, a depth gauge spring 96 resiliently urges the depth gauge 66 into a position such that the depth gauge catch 67 engages the egress side of the second door 62. The operation of the springs 90, 92, 94 and 96 will become more clear when the operation of the key lock mechanism 12 is further discussed below.

Figure 4:
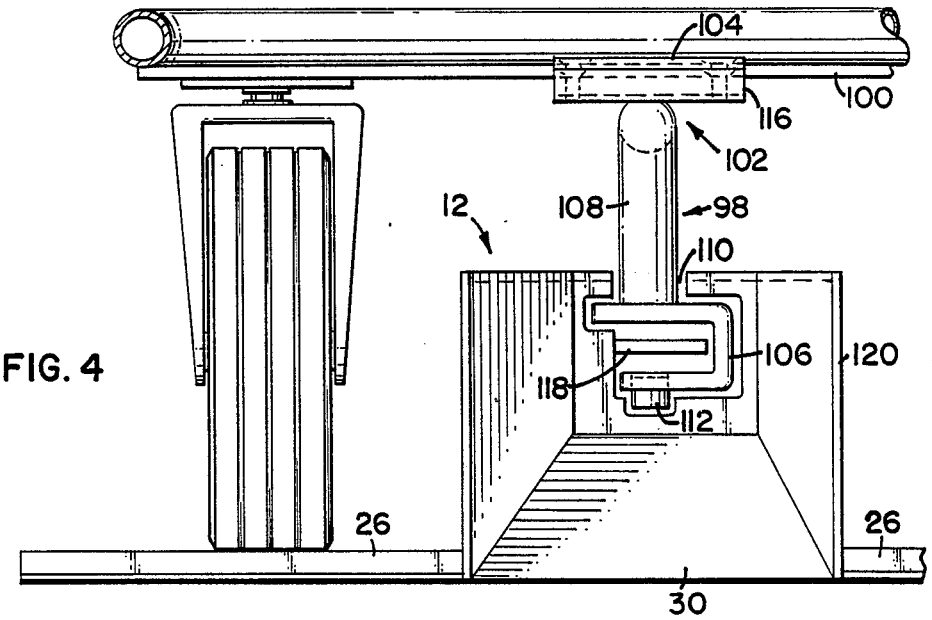
FIG. 4 is a front elevational view of the key lock apparatus shown in FIG. 1 and a valid key that is operable in the key detection apparatus.

FIG. 4 is an elevational view of ingress template 20 and key funnel 30. As noted above, a valid key 98 is mounted to a grocery cart frame 100 of grocery cart 114 has the appropriate size and shape to pass through an ingress template opening 21. The key 98 is preferably a steel weldment and is comprised of two portions, a bottom portion 102 and a top portion 104. The bottom portion 102 of the key 98 further comprises a key portion 106 that is upwardly supported by a key shaft 108. The key shaft 108 is welded to a bottom plate 116. The key shaft 108 extends through a slot 110 in the key lock mechanism and in the channel 16 as better seen in FIG. 1. Thus the key portion 106 of the key 98 is propelled through the lock mechanism 12 by the force generated on the cart 114 by the individual returning the cart and pushing the cart 114 through the lock mechanism. It should be noted that the key portion 106 of the key 98 could have a variety of tortuous, arcuate or angular designs to effectively preclude tampering and criss-crossing of carts between stores. Of course, the templates 21 and 34 and the internal placement and of components within the key lock mechanism 12 may have to be altered in order to accommodate a key having different key characteristics. Of particular note is a web 118 shown in FIGS. 4 and 3. The web 118 runs the length of the lock mechanism 12 and prevents intrusion into the mechanism 12 through the slot 110. The web 118 is a portion of a cover 120 that encases the lock mechanism 12. The cover 120 is formed of sheet steel and is fabricated using well-known techniques. One key characteristic of particular note as shown in FIG. 4 is a lowermost portion 112. The lowermost portion 112 is the portion of the key 98 that makes contact with the depth gauge ramp 68, thus releasing the second door 62, enabling the second door 62 to swing open thus cocking the vend bar 40.

Figure 5:
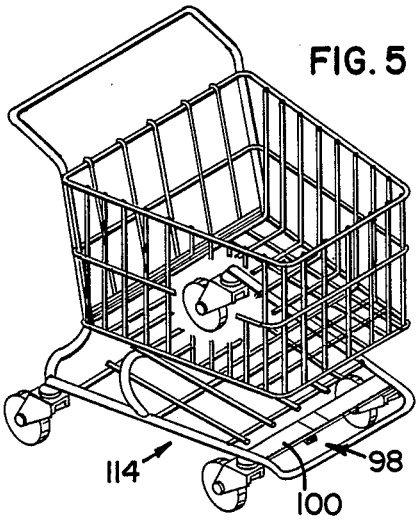
FIG. 5 is an isometric view of a grocery cart including a key, the key being operable in the key lock apparatus shown in FIG. 1.

FIG. 5 shows an isometric view of the cart 114. The valid key 98 is shown mounted to the cart frame 100 substantially midway between the front wheels of the cart 114. The valid key 98 clears the ground plane by an amount sufficient to preclude the possibility that it might scrape the ground and thereby interfere with the normal operation of the cart.

Figure 6:
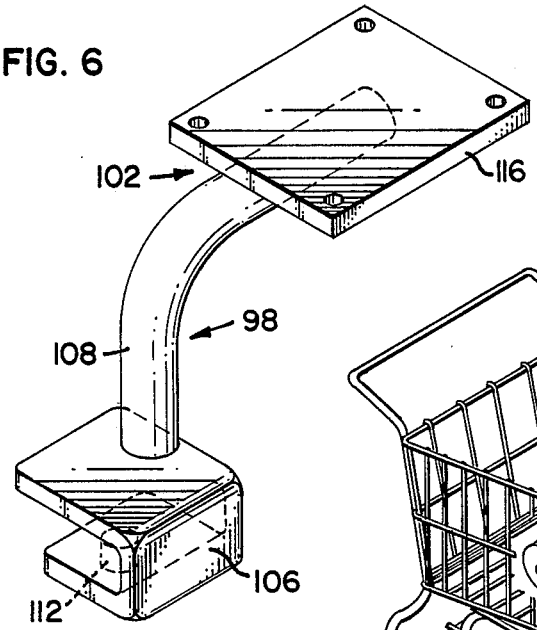
FIG. 6 is an enlarged perspective view of the key shown in FIG. 5.

FIG. 6 is an enlarged perspective view of the valid key 98 without the top portion 104. The valid key 98 preferably angles rearward to better isolate it from the front end of the cart 114. The key 98 is preferably formed using stainless steel. The key shaft 108 is bent stainless steel rod and key portion 106 is attached thereto using a standard technique, preferably welding. The key shaft 108 is preferably welded to a bottom plate 116. The top portion 104 is preferably screwed to the bottom plate 116, clamping the cart frame 100 therebetween as shown in FIG. 4.

Figure 7:
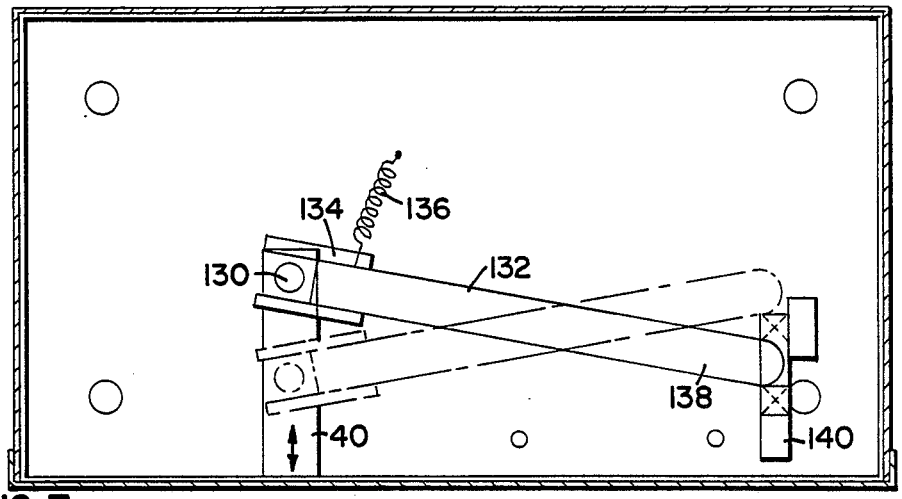
FIG. 7 is a cross-sectional view of the dispenser column of the return apparatus shown in FIG. 1, taken along line 7—7.

FIG. 7 is a cross-sectional view of the dispenser column 14. The vend bar 40 is in the position shown in solid lines when the mechanism 12 is uncocked. When mechanism 12 is cocked, the bar 40 moves to the position shown in phantom lines. Extending from the bar 40 is a stud 130. The stud 130 engages pivot bar 132 that has a forked end 134 that embraces the stud 130. An extension spring 136 resiliently urges the pivot bar 132 and vend bar 40 toward their uncocked positions. Extension spring 136 is attached to the base of dispenser column 14.

Figure 8:
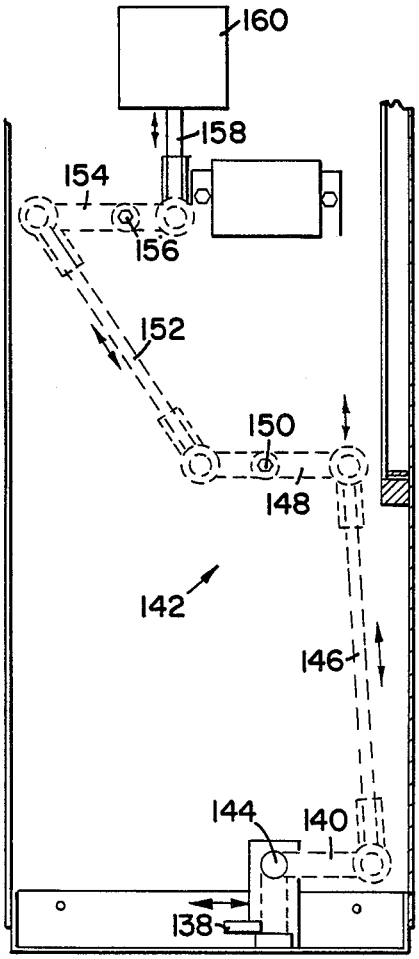
FIG. 8 is a cross-sectional view of the dispenser column of the return apparatus shown in FIG. 1, taken along 8—8.

A rounded end 138 of pivot bar 132 engages an L-shaped member 140, as seen in FIG. 8. FIG. 8 shows the "cocked" state of a dispensing mechanism 142. It is shown in phantom to correspond to the other figures. The components of dispensing mechanism 142 will be hereinafter discussed, and the "uncocked" state of the mechanism 142 will then be clear to those reasonably skilled in the art of linkage design.

End 138 of pivot bar 132 moves laterally as shown in FIG. 8. End 138 causes L-shaped member to pivot about first pivot pin 144. This causes a first upright member 146 to move vertically which rocks first rocker arm 148 about second pivot pin 150. A second upright member 152 is thus vertically moved to rock a second rocker member 154 about a third pivot pin 156. This in turn forces a third upright member 158 to move vertically, thus activating a coin dispenser 160. The coin dispenser 160 is of the type described in U.S. Pat. No. 3,978,959, issued to J. M. Muellner, and the aforesaid Muellner patent is hereby incorporated by reference. It will be clearly understood by those skilled in the art of cart return apparatuses that the type of dispenser mechanism described in U.S. Pat. No. 3,978,959 is usable in the cart return apparatus 10 and therefore need not be herein described in great detail.

The operation of the grocery cart return apparatus 10 can now be described in detail. To return a cart, the cart is rolled to the apparatus 10 so that the key 98 engages the inner surfaces of key funnel 30. The key funnel 30 guides the key 98 to the ingress template 20. If the cart key is sufficiently small and has the proper shape, it will pass through the ingress template opening 21 and make contact with the first door 42. Of course, the wheels of the cart roll up entrance ramps 26 and onto top panels 24 so that the key 98 better aligns itself with the ingress template opening 21. It should be particularly noted that carts that do not possess keys can of course be returned and nested with other carts that do have keys, but the returner of the cart will not receive a reward for the return of such a cart.

Upon making contact with the first door 42, the cart key 98 causes the first door cam 46 to push against the latch cam first portion 47 as best shown in FIG. 3. As the key 98 is propelled through the lock mechanism 12, the first door 42 pivots to a position shown in phantom in FIG. 3 and the first door cam 46 pushes the latch cam 48 through pressure on the latch cam first portion 47. The latch cam second portion 49 applies pressure to cam engaging portion 52 of door latch 50 which causes door latch 50 to pivot about the pin 56 and further causes the door catch 54 to engage the egress side of the second door 62. Thus, when the first door 42 is in its open position as shown in phantom in FIG. 3, the second door 62 is precluded from opening by the door latch 50. This feature makes the lock mechanism 12 resistant to long slender members and counterfeit keys that might be pushed through the first door 42 and into the second door 62. As long as the first door 42 is open, the second door 62 cannot be opened and the lock mechanism 12 will not cock the vend bar 40 to vend a token.

Once the key 98 has progressed beyond the upper first door portion 44, the first door spring 92 urges first door 42 to return to its original position as shown in solid line in FIG. 3. The first door cam 46 is thus brought out of contact with the latch cam first portion 47 and the latch cam 48 is returned to its original position due to the force generated on door latch 50 by the door latch spring 90. When the door latch 50 returns to its initial position as shown in solid lines in FIG. 3, the door catch 54 is brought out of contact with the egress side of the second door 62 and the second door is "enabled" to open.

At this point in the operation of the apparatus 10, the cart key 98 is in a key intermediate position between the first door 42 and the second door 62. As the key 98 progresses further toward the egress side of the key lock mechanism 12, the lowermost portion 112 of the key 98 ultimately makes contact with the depth gauge ramp 68, pushing the depth gauge 66 downward, rotating it about its pivot pin 69. This causes the depth gauge catch 67 to rotate away from the second door 62 so that the second door can pivot open upon contact with the key 98.

As the second door 62 rotates in response to a torque generated by the action of the cart key 98 on the second door 62, the circular member 63 of second door 62 engages the triangular portion 81 of vend pivot 80. Vend pivot stud 82 of vend pivot 80 thereby pushes against vend bar tip 39 to begin to cock vend bar 40.

When the second door 62 reaches its openmost position as shown in phantom in FIG. 3, the vend bar 40 is cocked and the dispensing mechanism 142 within the dispenser column 14 is prepared to dispense a reward to the returner of the cart. Once the key 98 reaches a key ending position beyond the second door 62, the second door 62 will return to its original position as shown in solid lines in FIG. 3 due to the action of the second door spring 94. An extension spring 136 (FIG. 7) acting upon the vend bar 40 within the dispensing column 14 causes the vend bar 40 to return to its original position which causes the vend pivot 80 to likewise return to the position shown in solid lines in FIG. 3. Similarly, the depth gauge 56 is urged back to its original position by the depth gauge spring 96.

Generally, as a result of the actions of the various springs of the mechanism 12, the mechanism 12 is returned to its original state and is prepared to receive another key and detect whether the key is a "valid" or "invalid" key.

It should be noted that other apparatuses will achieve the principles of the present invention. Generally, the lock mechanism according to the present invention "detects" characteristics of a key in order to determine whether the key is "valid." It should be particularly noted that, although the embodiment illustrated in the figures and discussed above includes a template and a depth gauge, other means for detecting key characteristics could be employed and still fall within the bounds of the invention. In a given embodiment, the key characteristics "detected" at the first door and the second door could be identical. That is, a template could be utilized at both doors, for example, the depth gauge 66 being omitted. Furthermore, it is not necessary that the device be completely mechanical in nature as was described above. Those skilled in the art of key and lock design will realize that electrical and electronic components could be utilized to achieve the results described above in an analogous fashion.

Numerous characteristics and advantages of the invention have been set forth in the foregoing detailed description. It will be understood, of course, that this disclosure is in many respects only illustrative. Changes may be made in details, particularly in matters of shape, size, and arrangement of parts without exceeding the scope of the invention as defined in the appended claims.

I claim:

1. A vehicle lock apparatus operable in response to a predetermined movement of a vehicle from a vehicle starting point to a vehicle intermediate point and finally to a vehicle ending point, the vehicle including a valid key having first and second characteristics, the valid first state to a second state in response to a corresponding predetermined movement of the valid key from a key starting point to a key intermediate point and finally to a key ending point, the valid key being operatively connected to the vehicle and configured to come into operative proximity with said lock apparatus during the predetermined movement of the vehicle and the valid key, said lock apparatus comprising:

(a) first means for detecting the valid key first characteristic, said first detecting means changing from a first state to a second state and back to said first state in response to movement of the valid key as the vehicle moves from the vehicle starting point to the vehicle intermediate point;

(b) second means for detecting the valid key second characteristic, said second detecting means changing between a first state and a second enabled state in response to movement of the valid key as the vehicle moves from the vehicle intermediate point to the vehicle ending point;

(c) means for enabling said second detecting means to change from its first state to its second enabled state, said enabling means being operatively connected to said first and second detecting means, wherein said enabling means prevents said second detecting means from changing from its first state to its second enabled state when said first detecting means is in its second state; and (d) anti-reversing means operatively connected to said second detecting means for preventing a key from passing from the key ending point to the key intermediate point, wherein said lock apparatus changes from its first state to its second state in response to said second detecting means changing from its second enabled state.

2. The lock apparatus as recited in claim 1, wherein said first detecting means comprises a first door generally disposed between the key starting point and the key intermediate point, said second detecting means comprises a second door generally disposed between the key intermediate point and the key ending point, said doors being closed in their first states, thereby obstructing keys, and said doors being open in their second states, thereby freely admitting keys, and wherein said anti-reversing means is operatively connected to said second door and prevents said second door from opening in response to a key that is proximate to the key ending point.

3. The lock apparatus as recited in claim 2, wherein the valid key first characteristic is the overall shape and size of the valid key, and said first detecting means further comprises means for determining whether a key is substantially similar in overall shape and size to the valid key.

4. The lock apparatus as recited in claim 3, wherein said overall shape and size similarity determining means comprises a template generally disposed between said first door and the key starting point, said template defining a template opening that is substantially in the shape of the valid key but has dimensions slightly larger than the valid key, whereby the valid key can freely pass through said template opening and said first door, but an invalid key having a size or shape that does not comport with said template opening is prevented from proceeding through said template opening and said first door and the vehicle is prevented from reaching the vehicle intermediate point.

5. The lock apparatus as recited in claim 2, wherein said second detecting means comprises a depth gauge generally disposed between said first and second doors, proximate to the key intermediate point, said depth gauge is operatively connected to said second door, wherein said depth gauge is operable in response to movement of the lowermost portion of the valid key to release said second door, permitting said second door to be opened by the valid key.

6. A vehicle lock apparatus operable in response to a predetermined movement of a vehicle from a vehicle starting point to a vehicle intermediate point and finally to a vehicle ending point, the vehicle including a valid key having first and second characteristics, the valid key being configured to change said lock apparatus from a first state to a second state in response to a corresponding predetermined movement of the valid key from a key starting point to a key intermediate point and finally to a key ending point, the valid key being operatively connected to the vehicle and configured to come into operative proximity with said lock apparatus during the predetermined movement of the vehicle and the valid key, said lock apparatus comprising:

(a) first means for detecting the valid key first characteristic, said first detecting means comprising a first door generally disposed between the key starting point and the key intermediate point, and said first detecting means further comprising a template generally disposed between the key starting point and said first door, said template defining a template opening that is substantially in the shape of the valid key but has dimensions slightly larger than the valid key, wherein the valid key can freely pass through said template opening and said first door, but an invalid key having a size or shape that does not comport with said template opening is prevented from proceeding through said template opening and said first door and the vehicle is prevented from reaching the vehicle intermediate point, said first door being closed in a first state and open in a second state and changing from its first state to its second state and back to its first state in response to movement of the valid key as the vehicle moves from the vehicle starting point to the vehicle intermediate point;

(b) second means for detecting the valid key second characteristic, said second detecting means comprising a second door generally disposed between the key intermediate point and the key ending point, said second door being closed in a first state and open in a second state and changing between its first state and its second state in response to movement of the valid key as the vehicle moves from the vehicle intermediate point to the vehicle end point, and said second detecting means further comprising a depth gauge generally disposed between said first and second doors, proximate to the key intermediate point, said depth gauge being operatively connected to said second door, wherein said depth gauge is operable in response to movement of the lowermost portion of the valid key to release said second door, permitting said second door to be opened by the valid key;

(c) means for enabling said second door to change from its first state to its second state, said enabling means being operatively connected to said first door and said second door, wherein said enabling means prevents said second door from opening when said first door is open; and (d) first anti-reversing means operatively connected to said second door for preventing a key from moving from the key ending point to the key intermediate point and second anti-reversing means operatively connected to said first door for preventing a key from moving from the key intermediate point to the key starting point, wherein said lock apparatus changes from its first state to its second state in response to said second door changing from its first state to its second state.

7. The vehicle lock apparatus as recited in claim 6, further comprising means for dispensing a token in response to said second door changing between its first state and its second state, said token dispensing means being operatively connected to said second door.

8. The vehicle lock apparatus as recited in claim 7, wherein the vehicle is a grocery cart including front wheels and rear wheels and a cart frame and the valid key is operatively connected to said cart frame centrally disposed between the front wheels of the cart.

9. The vehicle lock apparatus as recited in claim 8, further comprising a frame, and wherein said first and second doors and said enabling means are vertically pivotally connected to said frame and said enabling means comprises a first portion for operative movement in response to movement of said first door, and said enabling means comprises a second portion for operative engagement with said second door; wherein said depth gauge is horizontally pivotally connected to said frame and said depth gauge comprises a first portion for operative engagement with the lowermost portion of the valid key and a second portion for operative engagement with said second door; said token dispensing means comprises a vend bar slidably disposed within said frame and a token dispenser, said vend bar and said token dispenser being operatively interconnected; and said lock apparatus further comprises means for slidably containing the valid key once the valid key has reached the key ending point.

10. A vehicle lock system comprising:

(a) a vehicle;

(b) a valid key including first and second characteristics, said valid key being operatively connected to said vehicle; and (c) a vehicle lock apparatus operable in response to a predetermined movement of said vehicle from a vehicle starting point to a vehicle intermediate point and finally to a vehicle ending point, wherein said valid key is configured to change said lock apparatus from a first state to a second state in response to a corresponding predetermined movement of said valid key from a key starting point to a key intermediate point and finally to a key ending point, said valid key being configured to come into operative proximity with said lock apparatus during the predetermined movement of said vehicle and said valid key, said lock apparatus comprising:

(i) first means for detecting said valid key first characteristic, said first detecting means changing from a first state to a second state and back to said first state in response to movement of said valid key as said vehicle moves from said vehicle starting point to said vehicle intermediate point;

(ii) second means for detecting said valid key second characteristic, said second detecting means changing between a first state and a second enabled state in response to movement of said valid key as said vehicle moves from said vehicle intermediate point to said vehicle ending point;

(iii) means for enabling said second detecting means to change from said second detecting means first state to said second detecting means second enabled state, said enabling means being operatively connected to said first and second detecting means, wherein said enabling means prevents said second detecting means from changing from said second detecting means first state to said second detecting means second enabled state when said first detecting means is in said first detecting means second state; and (iv) anti-reversing means operatively connected to said second detecting means for preventing a key from passing from said key ending point to said key intermediate point, wherein said lock apparatus changes from said lock apparatus first state to said lock apparatus second state in response to said second detecting means first state to said second detecting means second enabled state.

11. The lock system as recited in claim 10, wherein said first detecting means comprises a first door generally disposed between said key starting point and said key intermediate point, and said second detecting means comprises a second door generally disposed between said key intermediate point and said key ending point, said doors being closed in their first states, thereby obstructing keys, and said doors being open in their second states, thereby freeing admitting keys.

12. The lock system as recited in claim 11, wherein said valid key first characteristic is the overall shape and size of said valid key, and said first detecting means comprises means for determining whether a key is substantially similar in overall shape and size to said valid key.

13. The lock system as recited in claim 12, wherein said overall shape and size determining means comprises a template generally disposed between said first door and said key starting point, said template defining a template opening that is substantially in the shape of said valid key but has dimensions slightly larger than said valid key, whereby said valid key can freely pass through said template opening and said first door, but an invalid key having a size or shape that does not comport with said template opening is substantially prevented from proceeding through said template opening and said first door and said vehicle is prevented from reaching said vehicle intermediate point.

14. The lock system as recited in claim 11, wherein said second detecting means comprises a depth gauge, said depth gauge being generally disposed between said first and second doors, proximate to said key intermediate point, and said depth gauge is operatively connected to said second door, wherein said depth gauge is operable in response to movement of the lowermost portion of said valid key to release said second door, permitting said second door to be opened by said valid key.

15. A vehicle lock system comprising:

(a) a vehicle;

(b) a valid key including first and second characteristics, said valid key being operatively connected to said vehicle; and (c) a vehicle lock apparatus operable in response to a predetermined movement of said vehicle from a vehicle starting point to a vehicle intermediate point and finally to a vehicle ending point, wherein said valid key is configured to change said lock apparatus from a first state to a second state in response to a consequent predetermined movement of said valid key from a key starting point to a key intermediate point and finally to a key ending point, said valid key being configured to come into operative proximity with said detection apparatus during the predetermined movement of said vehicle and said valid key, said lock apparatus comprising:

(i) first means for detecting said valid key first characteristic, said first detecting means comprising a first door generally disposed between said key starting point and said key intermediate point, and said first detecting means further comprising a template generally disposed between said key starting point and said first door, said template defining a template opening that is substantially in the shape of said valid key but has dimensions slightly larger than said valid key, whereby said valid key can freely pass through said template opening and said first door, but an invalid key having a size or shape that does not comport with said template opening is substantially prevented from proceeding through said template opening and said first door and said vehicle is prevented form reaching said vehicle intermediate point, said first door being closed in a first state and open in a second state and changing from its first state to its second state and back to its first state in response to movement of said valid key as said vehicle moves from said vehicle starting point to said vehicle intermediate point;

(ii) second means for detecting said valid key second characteristic, said second detecting means comprising a second door generally disposed between said key intermediate point and said key ending point, said second door being closed in a first state and open in a second state and changing between its first state and its second state in response to movement of said valid key as said vehicle moves from said vehicle intermediate point to said vehicle end point, and said second detecting means comprising a depth gauge generally disposed between said first and second doors, proximate to said key intermediate point, said depth gauge being operatively connected to said second door, wherein said depth gauge is operable in response to movement of the lowermost portion of said valid key to release said second door, permitting said second door to be opened by said valid (iii) means for enabling said second door to change from its first state to its second state, said enabling means being operatively connected to said first door and said second door, wherein said enabling means prevents said second door from opening when said first door is open; and (iv) first anti-reversing means operatively connected to said second door for preventing a key from moving said key ending point to said key intermediate point and second anti-reversing means operatively connected to said first door for preventing a key from moving from said key intermediate point to said key starting point, wherein said lock apparatus changes from its first state to its second state in response to said second door changing from its first state to its second state.

16. The vehicle lock system as recited in claim 15, further comprising means for dispensing a token in response to said second door changing between its first state and its second state, said token dispensing means being operatively connected to said second door.

17. The vehicle lock system as recited in claim 16, wherein said vehicle is a grocery cart including front wheels and rear wheels and a cart frame and the valid key is operatively connected to said cart frame centrally disposed between the front wheels of the cart.

18. The vehicle lock system as recited in claim 17, further comprising a frame, and wherein said first and second doors and said enabling means are vertically pivotally connected to said frame and said enabling means comprises a first portion for operative movement in response to movement of said first door, and said enabling means comprises a second portion for operative engagement with said second door; wherein said depth gauge is horizontally pivotally connected to said frame and said depth gauge comprises a first portion for operative engagement with the lowermost portion of the valid key and second portion for operative engagement with said second door; said token dispensing means comprises a vend bar slidably disposed within said frame and a token dispenser, said vend bar and said token dispenser being operatively interconnected; and said lock apparatus further comprises means for slidably containing the valid key once the valid key has reached the key ending point.

19. A method for detecting a vehicle, said detecting method being responsive to a predetermined movement of the vehicle from a vehicle starting point to a vehicle intermediate point and finally to a vehicle ending point, the vehicle including a valid key having first and second characteristics, the valid key being operatively connected to the vehicle, and the valid key having a key starting point, a key intermediate point and a key ending point, said detecting method comprising:

(a) detecting the valid key first characteristic and opening a first door in response to movement of the valid key as the vehicle moves from the vehicle starting point to the vehicle intermediate point;

(b) preventing a second door from operating a vend mechanism while said first door is open;

(c) closing said first door when the valid key reaches the key intermediate point and allowing said second door to operate a vend mechanism;

(d) detecting the valid key second characteristic and opening said second door in response to movement of the valid key as the vehicle moves from the vehicle intermediate point to the vehicle ending point.

(e) operating a vend mechanism and vending a token in response to opening and closing of said second door;

(f) slidably containing the valid key; and (g) preventing the valid key from moving from the key ending point to the key intermediate point.

20. A grocery cart comprising:

(a) a pair of front wheels;

(b) a pair of rear wheels;

(c) a cart frame; and (d) a valid key having first and second characteristics, wherein said front wheels and said rear wheels are operatively connected to the front and the rear of said frame, respectively, wherein said valid key is operatively connected to said cart frame centrally disposed between the front wheels of the cart, and wherein said valid key extends below said cart frame and is particularly configured for engaging a lock apparatus as said cart moves from a cart starting point to a cart intermediate point and finally to a cart ending point, said valid key to irreversibly change said lock apparatus from a first state to a second state in response to movement of the said valid key from a key starting point to a key intermediate point and finally to a key ending point.

21. The grocery cart as recited in claim 20, wherein said valid key comprises a substantially C-shaped portion.

22. The grocery cart as recited in claim 21, wherein said C-shaped portion comprises an upper member and a lower member, said lower member further comprising a studlike member extending substantially perpendicularly therefrom, and said studlike member being the lowermost portion of said valid key.

* * * * *

UNITED STATES PATENT AND TRADEMARK OFFICE

CERTIFICATE OF CORRECTION

PATENT NO. : 4,518,073

DATED : May 21, 1985

INVENTOR(S) : Eugene R. Pastien

It is certified that error appears in the above-identified patent and that said Letters Patent is hereby corrected as shown below:

Column 7, line 11, "24" should be --34--.

Column 11, line 62, after "valid" insert the words --key being configured to change said lock apparatus from a --

Column 16, line 44, after "valid" insert --key;--.

Signed and Sealed this

*Eleventh* Day of *February 1986*

[SEAL]

*Attest:*

DONALD J. QUIGG

*Attesting Officer* *Commissioner of Patents and Trademarks*